United States Patent [19]

Gardner et al.

[11] 4,300,687

[45] Nov. 17, 1981

[54] PACKAGING STRUCTURE

[75] Inventors: Jeffrey M. Gardner, Wheaton; Bennie C. Nelson, Jr., Romeoville, both of Ill.

[73] Assignee: Container Corporation of America, Chicago, Ill.

[21] Appl. No.: 146,492

[22] Filed: May 5, 1980

[51] Int. Cl.[3] ..... B65D 85/18

[52] U.S. Cl. ..... 206/279; 206/45.21; 206/288; 206/491

[58] Field of Search ..... 224/279, 284, 288, 295, 224/297, 299, 491; 229/16 A, 16 R, 30; 206/45.21, 45.25, 45.29

[56] References Cited

U.S. PATENT DOCUMENTS

| | | | |
|---|---|---|---|
| 1,860,309 | 5/1932 | Davidson | 206/45.21 |
| 2,248,547 | 7/1941 | Osteen | 206/45.21 |
| 2,414,671 | 1/1947 | Rosenthal | 206/45.21 |
| 2,532,216 | 11/1950 | Williamson | 206/45.25 |
| 2,675,913 | 4/1954 | Hanson | 206/45.21 |
| 3,722,783 | 3/1973 | Rous | 206/491 X |
| 4,098,399 | 7/1978 | Bethune et al. | 206/288 |
| 4,119,197 | 10/1978 | Pilz | 206/279 |
| 4,158,406 | 6/1979 | Feder | 206/279 |

*Primary Examiner*—Steven M. Pollard

*Attorney, Agent, or Firm*—R. W. Carpenter; Davis Chin

[57] ABSTRACT

A packaging structure for hanger supported articles is disclosed. Support of the articles is achieved by panels in partially overlapping relationship and joined by tab panels foldably joined to the panels and erected by overlapping of the panels into facing relationship to form a rail for support of hangers, the tab panels being maintained in locked relationship by the overlapping panel.

2 Claims, 7 Drawing Figures

PACKAGING STRUCTURE

SUMMARY OF THE INVENTION

The invention structure finds special application in the packaging of articles of apparel supported on hangers. The structure includes overlapping panels with panel tabs erected to position in overlapping of the panels, the panel tabs being in facing relationship to provide a rail for support of the hangers. The overlapping panels are so constructed as to cause the erected panels to be in locked relationship.

THE DRAWINGS

THE SPECIFICATION

Figure 2:
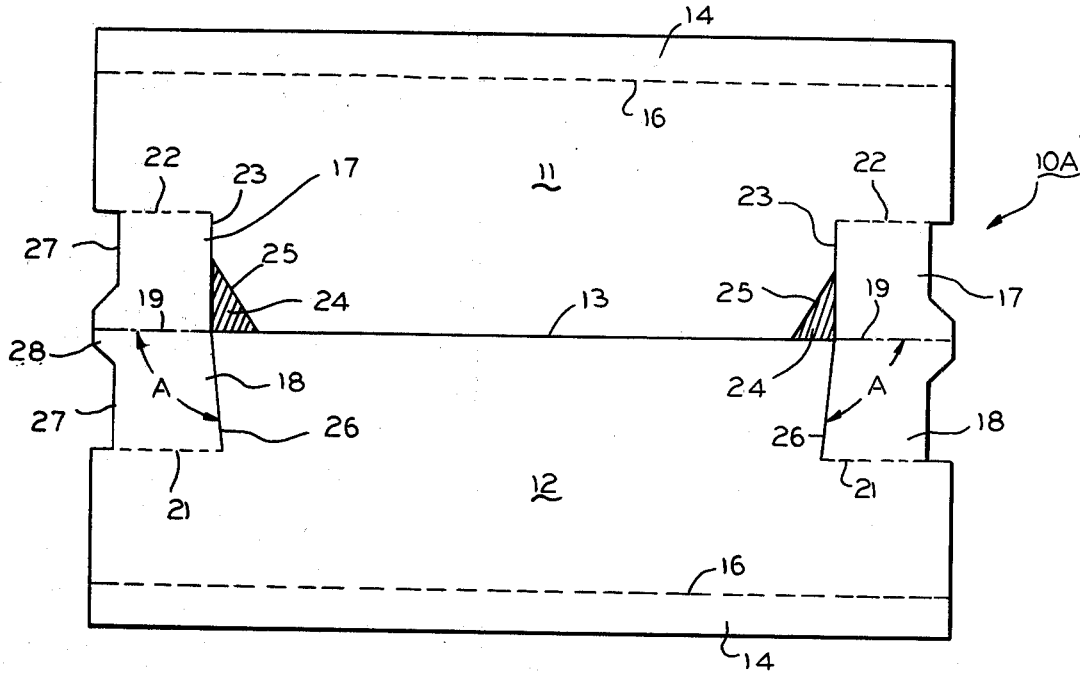
FIG. 2 is a plan view of a cut and scored blank employed in the structure of FIG. 1.
Figure 3:
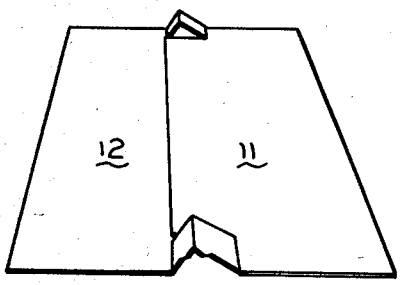
FIG. 3 is a perspective view showing a step in forming the structure of FIG. 1.
Figure 1:
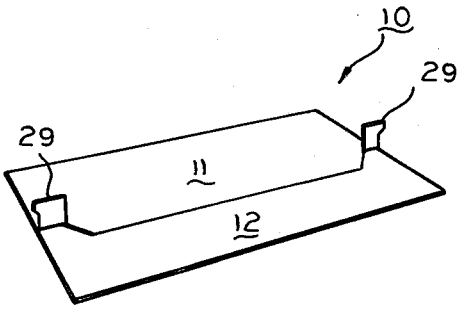
FIG. 1 is a perspective view of the invention structure according to one embodiment thereof.

The packaging structure according to one embodiment of the invention is denoted by the reference numeral 10, and is formed from a cut and scored blank 10A of paperboard or the like. As seen in FIGS. 1 to 4, structure 10 includes first and second panels 11 and 12 with a longitudinal cut line 13 extending therebetween. Panels 11 and 12 are joined at the ends thereof by paired panel tabs 17 and 18 joined along a fold line 19 aligned with cut line 13.

Panel tab 18 is connected to panel 12 along a fold line 21, and is defined by cut line 26 extending at an angle A with respect to fold line 19 slightly greater than 90°. Panel tab 17 is connected to panel 11 along a fold line 22 and is defined by a cut line 23, there being a small triangular cut-out 24 defined in part by cut line 13 and a cut line 25 between tab 17 and panel 11.

First panel 11 is brought over second panel 12, and in so doing panel tabs 17 and 18 are erected to move into facing relationship. By reason of the cut lines 23 and 26, the edge of panel 11 at cut line 23 has frictional engagement with the edge of panel tab 18 at cut line 26. Preferably, there is such contact thereat as to cause crushing of the fibers of the material, and locking engagement with panel tabs 17 and 18 in facing relationship is thereby assured.

Figure 4:
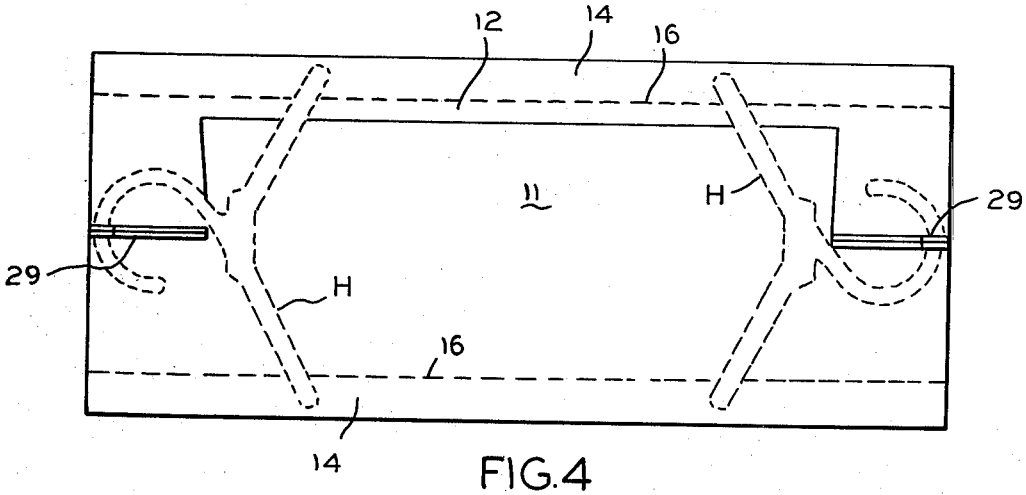
FIG. 4 is a plan view of FIG. 1 showing article hangers placed thereon.

Panel tabs 17 and 18 are additionally defined at edges 27 and stops 28, so that when tabs 17 and 18 are in facing relationship a rail 29 is defined, which as seen in FIG. 4 enables hangers H to be arranged thereon.

The structure 10 described is preferably placed in a conventional shipping container, not shown, with the upturned flaps 14 serving to locate structure 10 properly therein.

Figure 5:
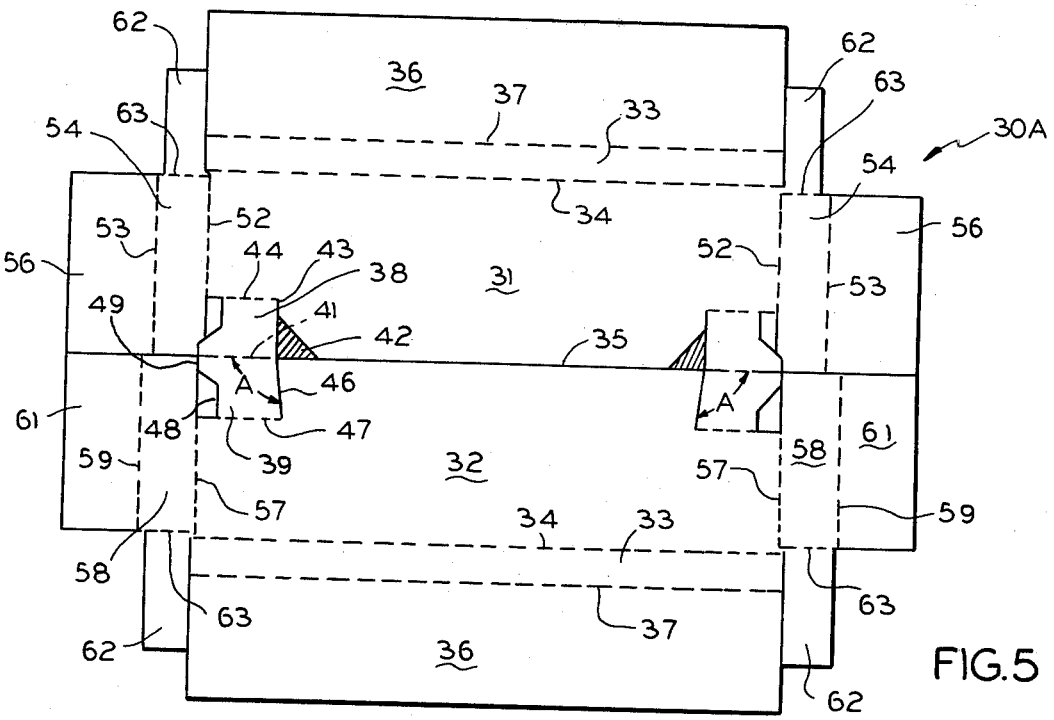
FIG. 5 is a plan view of a cut and scored blank for forming an invention structure according to another embodiment.
Figure 6:
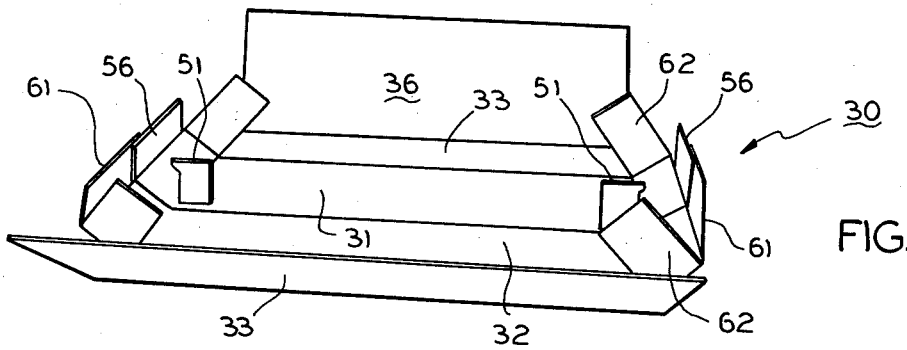
FIG. 6 is a perspective view showing a step in the folding of the blank of FIG. 5.
Figure 7:
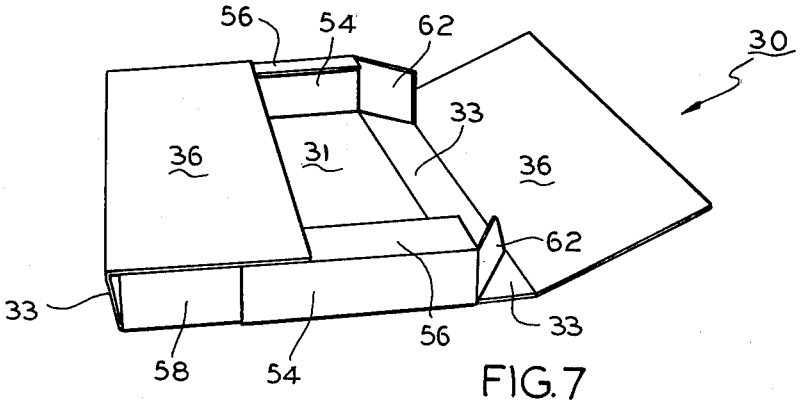
FIG. 7 is a perspective view showing a further step in folding of the blank of FIG. 5.

Referring now to FIGS. 5 to 7, there is shown another embodiment of the invention wherein the same is part of other structure forming a completed shipping container. This embodiment of the invention is denoted by reference numeral 30 and is formed from a cut and scored blank 30A.

Structure 30 includes first and second panels 31 and 32 with a longitudinally extending cut line 35 therebetween. Each panel 31 and 32 has a side wall 33 foldable with respect thereto along a fold line 34, and each side wall 33 has a closure panel 36 foldable with respect thereto along a fold line 37.

The two panels 31 and 32 are connected to each other at distal ends thereof by paired panel tabs 38 and 39 connected to each other along fold lines 41 aligned with cut line 35.

A cut-out 42 is located inboard of each panel tab 38 and is separated from tab 38 by cut line 43 extending normal to fold line 41 and cut line 35. Panel 38 is folded with respect to panel 31 along a fold line 44 extending parallel to fold line 41. Panel tab 39 is defined by a cut line 46 which with fold line 41 describes an angle A of slightly more than 90°. Tab 39 is foldable with respect to panel 32 along fold lines 47 parallel to fold line 41.

By reason of the contact of panel 31 at cut line 43 with the cut line 46 of panel tab 39, when panel tabs 38 and 39 are erected they are locked together in facing relationship by the interference between panel 31 and panel tab 39.

Tabs 39 and 39 are additionally defined by edges 48 and a stop 49, so that when the tabs 38 and 39 are in facing relationship a rail 51 is formed.

The distal ends of panel 31 are provided with end wall portions 54 foldable with respect to panel 31 along fold lines 52, and end closure flaps 56 are each folded to wall portion 54 along fold line 53.

The distal ends of panel 32 are likewise provided with end wall portions 58 at fold lines 57, and closure flaps 61 are foldably connected to wall portions 58 at fold lines 59.

Dust flaps 62 are folded with respect to wall portions 54 and 58 along fold lines 63.

The package structure 30 seen in FIGS. 5 to 7 is formed in an initial step of partially lapping panel 31 over panel 32 causing panel tabs 38 and 39 to be erected. The edges of panel 31 at cut line 43 causes interference locking of tabs 38 and 39 at cut line 46 between panel 32 and tab 39.

Tabs 38 and 39 are then in facing relationship to provide the rails 51 for support of hangers H (not shown in these views).

The lapping of panels 31 and 32 causes similar lapping of portion 54 and flap 56 inside of portion 58 and flap 61. Dust flaps 62 are folded to position inside of portions 58 and 54 and flaps 56 and 61. Thereafter side walls 33 are erected and closure panels 36 folded to position.

We claim:

1. A packaging structure formed from a cut and scored blank of paperboard material comprising:

(a) first and second panels separated by a cut line extending longitudinally thereof and joined at least at one end thereof by paired panel tabs;

(b) the panel tabs each being foldable with respect to an adjacent panel and each tab being joined to the other tab along a fold line;

(c) one of said panel tabs being defined by a cut line between the same and its adjacent panel and extending normal to the longitudinal cut line between the panels;

(d) the other of said panel tabs being defined by a cut line between the same and its adjacent panel and extending other than normal to the longitudinal cut line, so that the included angle at the fold line between the other panel tab at the longitudinal cut line and at said last named cut line is slightly greater than 90°;

(e) said first and second panels being movable to overlapping position with said panel tabs being folded to erect position into facing relationship, the normal extending cut line of the overlapping panel having the edge thereof in frictional engagement with the edge of the other panel tab as defined by the cut line defining an angle other than 90°.

2. A container for hanger supported articles of clothing, said container being formed from a cut and scored blank of paperboard material and comprising:

(a) a bottom wall having end and side walls and a top wall;

(b) said bottom wall being formed from first and second panels separated by a cut line extending longitudinally thereof and joined at least at one end thereof by paired panel tabs;

(c) the panel tabs each being foldable with respect to an adjacent panel and each tab being joined to the other tab along a fold line;

(d) one of said panel tabs being defined by a cut line between the same and its adjacent panel and extending normal to the longitudinal cut line between the panels;

(e) the other of said panel tabs being defined by a cut line between the same and its adjacent panel and extending other than normal to the longitudinal cut line, so that the included angle at the fold line between the other panel tab at the longitudinal cut line and at said last named cut is slightly greater than 90°.

(f) said first and second panels being movable to overlapping position with said panel tabs being folded to erect position into facing relationship, the normal extending cut line of the overlapping panel having the edge thereof in frictional engagement with the edge of the other panel tab as defined by the cut line defining an angle other than 90°.

* * * * *